United States Patent [19]

Jacoby

[11] Patent Number: 4,597,334

[45] Date of Patent: Jul. 1, 1986

[54] TURNTABLE FOR A SYSTEM OF DRIVERLESS VEHICLES

[75] Inventor: Charles E. Jacoby, Bethlehem, Pa.

[73] Assignee: SI Handling Systems, Inc., Easton, Pa.

[21] Appl. No.: 328,283

[22] Filed: Dec. 7, 1981

[51] Int. Cl.[4] ..... B61J 1/00

[52] U.S. Cl. ..... 104/37; 104/35; 104/46; 104/166; 198/369

[58] Field of Search ..... 104/35–37, 104/46, 99, 165, 166; 198/369, 370, 414, 480, 800

[56] References Cited

U.S. PATENT DOCUMENTS

| | | | |
|---|---|---|---|
| 616,080 | 12/1898 | Cory | 104/37 |
| 3,100,039 | 8/1963 | Oderman et al. | 198/414 |
| 3,442,410 | 5/1969 | Solomonson | 198/414 X |
| 3,690,267 | 9/1972 | Sutton | 104/165 |
| 3,861,322 | 1/1975 | Danly | 104/166 |
| 3,929,079 | 12/1975 | Eliassen | 104/48 X |
| 4,041,873 | 8/1977 | Jones | 104/35 |
| 4,059,053 | 11/1977 | Jones | 104/35 |
| 4,077,327 | 3/1978 | Ziegenfus et al. | 104/35 |
| 4,094,252 | 6/1978 | Pater et al. | 104/38 X |
| 4,326,624 | 4/1982 | Ewertowski et al. | 198/370 |

FOREIGN PATENT DOCUMENTS

| | | | |
|---|---|---|---|
| 785095 | 12/1980 | U.S.S.R. | 104/37 |

*Primary Examiner*—Randolph A. Reese

*Attorney, Agent, or Firm*—Seidel, Gonda, Goldhammer & Abbott

[57] ABSTRACT

A turntable for driverless vehicles rides on a horizontally disposed circular rail and is pivotable about a vertical axis through an arc of 90°. A vertical shaft is connected at its upper end to the table by way of a universal coupling. A motor is connected to the shaft to pivot the shaft. The turntable is particularly adapted for use at a T junction of a system having a closed loop.

10 Claims, 5 Drawing Figures

FIG. 3
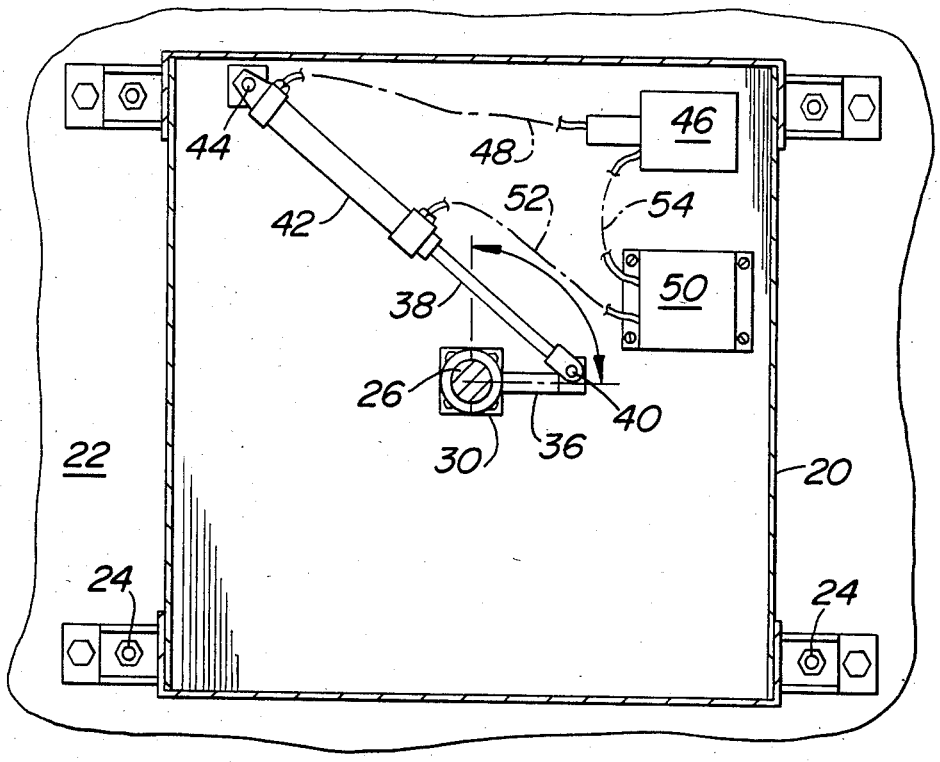
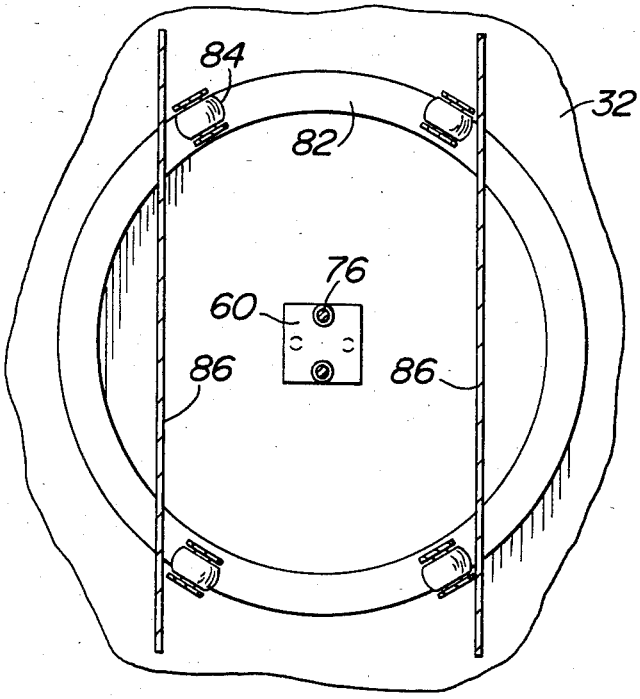
FIG. 4

TURNTABLE FOR A SYSTEM OF DRIVERLESS VEHICLES

BACKGROUND

Turntables for driverless vehicles of the general type involved herein are known. For example, see U.S. Pat. No. 4,041,873.

There is a need for a turntable which can control traffic at a T junction while having a vehicle track thereon at an elevation of about 63 centimeters above floor level for compatibility with the remainder of the system. The present invention is directed to a solution of that problem.

SUMMARY OF THE INVENTION

The turntable of the present invention is particularly designed for use with driverless vehicles of the type having a drive wheel adapted for frictional driving contact with a drive shaft. The turntable includes a horizontally disposed circular rail and a table which rides on said rail while pivoting about a vertical axis through an arc of 90°. A vertical shaft has its upper end connected to the table by way of the universal coupling. A motor means is connected to the shaft for pivoting said shaft and table.

The table is provided with a track for driverless vehicles. The track includes rails along opposite sides of the track. One of the rails is a horizontally disposed drive shaft. A motor is provided on the table for rotating said drive shaft about its longitudinal axis. A traffic control device is provided on the track between said rails for controlling movement of driverless vehicles.

It is an object of the present invention to provide a turntable which may be used in a driverless vehicle system at a T junction.

It is another object of the present invention to provide a turntable adapted to transfer driverless vehicles between tracks which are at right angles to each other and at an elevation whereby a person sitting on a seat can place his knees beneath the tracks.

Other objects and advantages will appear hereinafter.

For the purpose of illustrating the invention, there is provided in the drawings a form which is presently preferred; it being understood, however, that this invention is not limited to the precise arrangements and instrumentalities shown.

FIG. 3 is a sectional view taken along the line 3—3 in FIG. 2.

FIG. 4 is a sectional view taken along the line 4—4 in FIG. 2.

DETAILED DESCRIPTION

Figure 1:
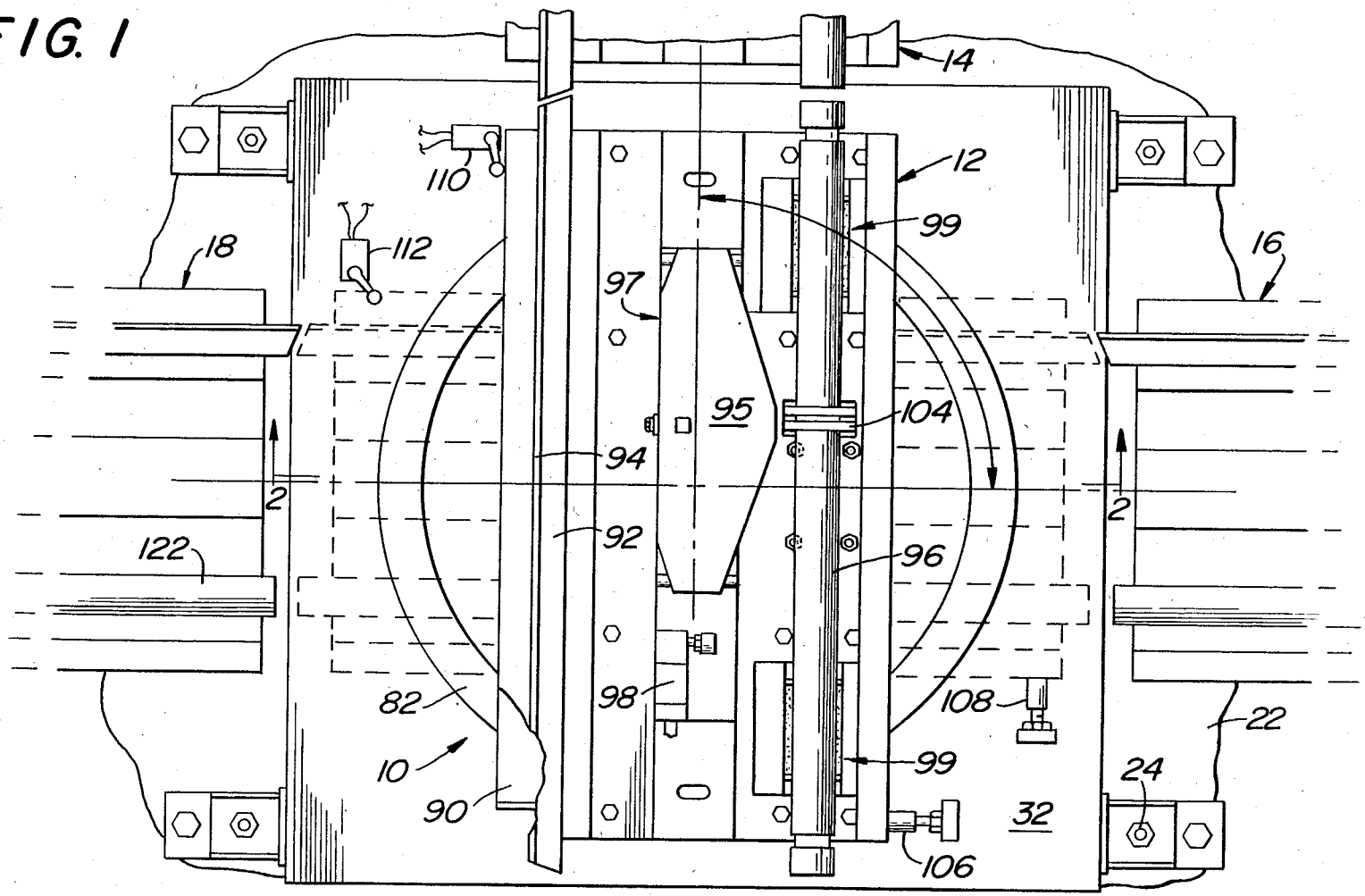
FIG. 1 is a top plan view of a T junction of a driverless vehicle conveyor system with the turntable of the present invention at said junction.

Referring to the drawing in detail, wherein like numerals indicate like elements, there is shown in FIG. 1 a turntable 10 at a T junction of a driverless vehicle conveyor system involving track 14 which is perpendicular to aligned tracks 16 and 18. The turntable 10 includes a track 12 at the same elevation as the tracks 14, 16 and 18 and which is preferably about 63 centimeters above the level of floor 22. The turntable 10 is shown in FIG. 1 aligned with the track 14 and is pivotable through an arc of 90° to the phantom position wherein it is aligned with the tracks 16, 18.

Figure 2:
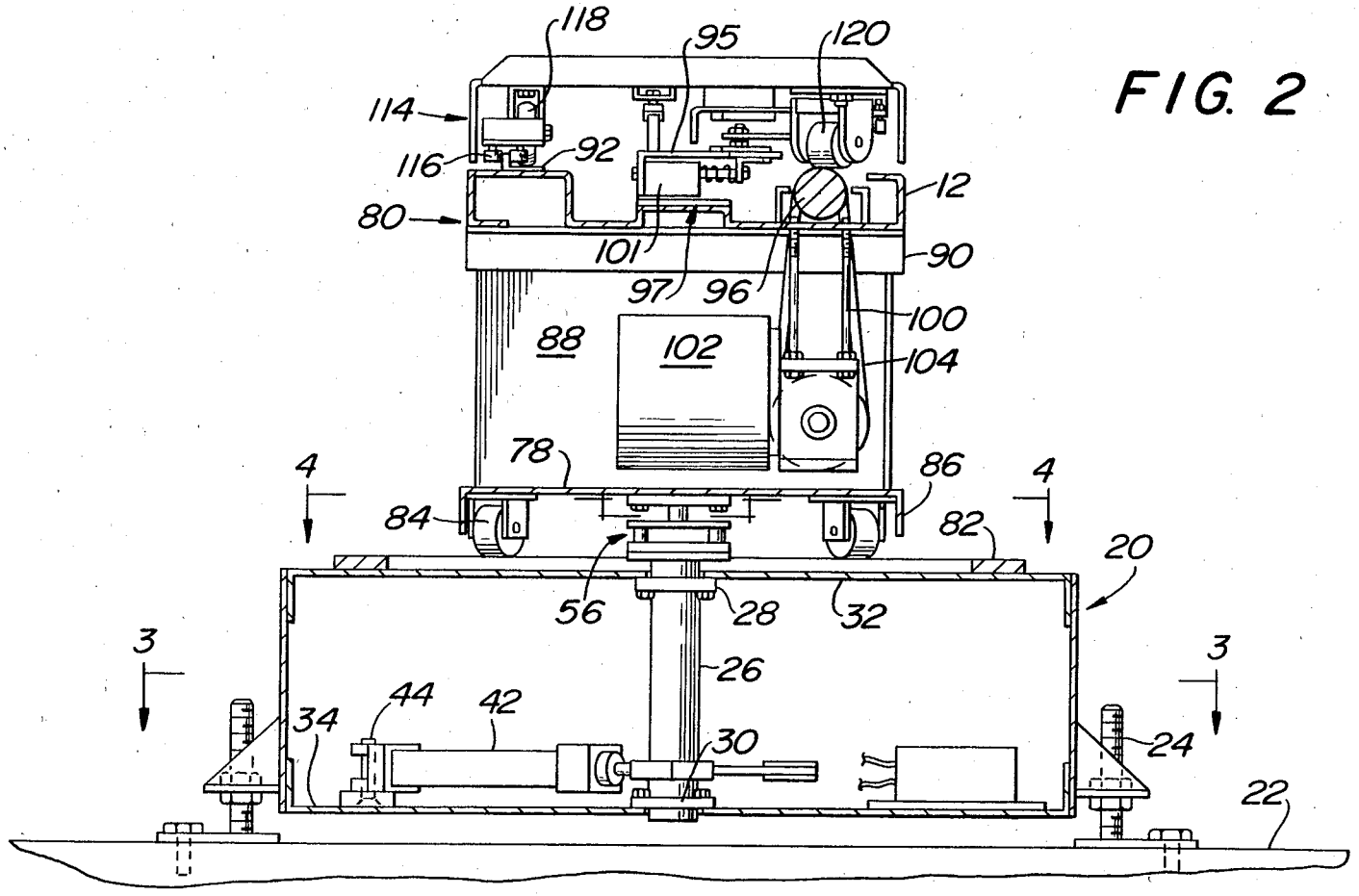
FIG. 2 is a sectional view taken along the line 2—2 in FIG. 1.

Referring to FIG. 2, the turntable 10 includes a hollow base 20. As shown in FIGS. 2 and 3, the base 20 is rectangular and its corners are adjustably attached to the floor 22 by bolts 24. Bolts 24 extend through holes in corner brackets with nuts above and below the brackets to facilitate leveling.

Within the hollow base 20 there is provided a vertically disposed shaft 26. Shaft 26 is connected to the top wall 32 of the base 20 by way of a bearing 28. Shaft 26 is connected to the bottom wall 34 of the base 20 by way of a similar bearing 30. Intermediate the walls 32, 34 the shaft 26 is provided with a radially outwardly extending arm 36. See FIG. 3. The free end of arm 36 is pivotably connected to one end of piston rod 38 by pin 40. The piston rod 38 is connected to a piston within cylinder 42. One end of cylinder 42 is pivotably connected to the bottom wall 34 of the base 20 by way of a pin 44.

Motive fluid may be introduced into opposite ends of the cylinder 42 to reciprocate the piston rod 38 and thereby pivot the shaft 26 in any convenient manner. Preferably such motive fluid is controlled by an air-oil tank 46 connected to one end of the cylinder 42 by way of conduit 48. The other end of the cylinder 42 is connected by way of conduit 52 to a four-way air valve 50. Valve 50 is connected to the air chamber above the oil in tank 46 by way of conduit 54. Valve 50 is controlled by a micro computer at a control panel not shown. The movable member in valve 50 may be stroked in any convenient manner by way of a pilot valve or a solenoid to alternatively pressurize one end of cylinder 42 and exhaust the other end of cylinder 42.

Figure 5:
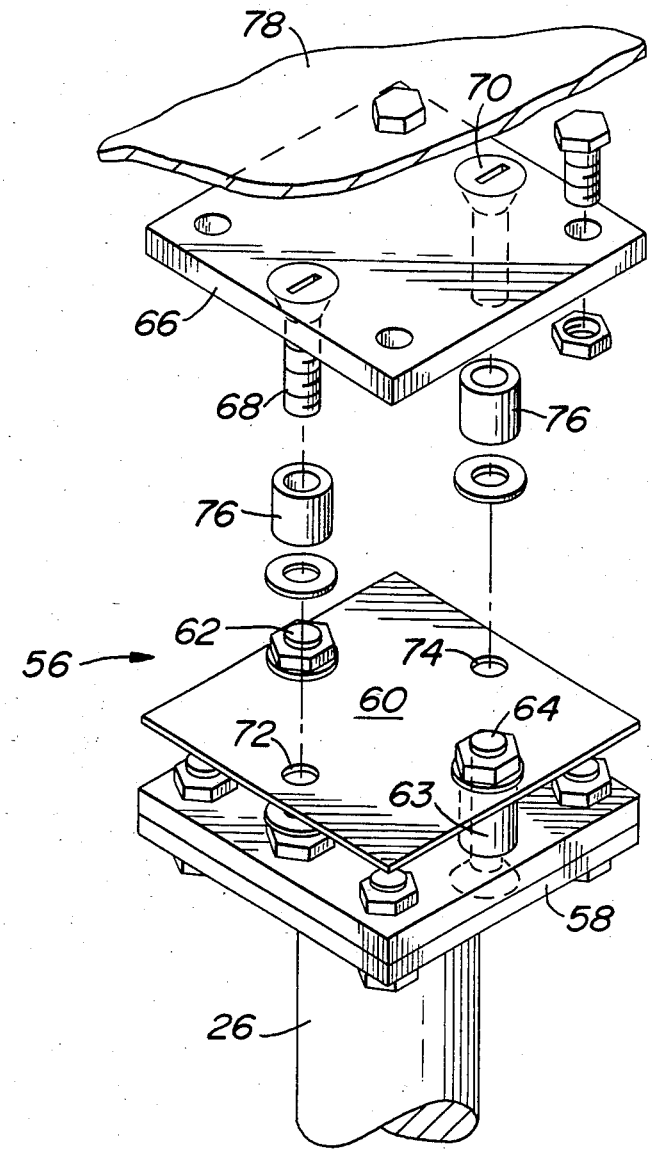
FIG. 5 is an exploded view of the universal coupling.

Referring to FIGS. 2 and 5, the upper end of shaft 26 is connected to a universal coupling 56 which may assume a wide variety of configurations. Coupling 56 preferably includes a rigid plate 58 attached to the upper end of shaft 26. Plate 58 is connected to a flexible substrate 60 by fasteners 62, 64. Substrate 60 is spaced from plate 58 by spacers in the form of bushings 63 which surround the fasteners 62, 64. A second plate 66 is above and parallel to the plate 58. Plate 66 is a rigid plate connected to the substrate 60 by fasteners 68 and 70 and spaced therefrom by the bushings 76 which surround the fasteners 68, 70. Fastener 68 extends through hole 72 in the substrate 60 while fastener 70 extends through hole 74 in the substrate 60.

The fasteners 62, 64 define a line which is perpendicular to a line defined by the fasteners 68, 70. As a result thereof, the rigid plates 58 and 60 may move with respect to one another with such movement being provided by way of flexure of the substrate 60. Plate 66 is fixedly secured by way of fasteners to the bottom wall 78 of a table 80. Table 80 has a plurality of wheels 84 arranged about the axis of shaft 26 so that such wheels may roll on a circular rail 82 therebelow. Rail 82 is preferably bolted to the top wall 32 on the base 20. See FIGS. 2 and 4.

A table 80 is provided with a pair of depending skirts 86 which are parallel to one another. Skirts 86 provide a safety feature in preventing direct access to the wheels 84 during operation and perform an addition function to be described hereinafter. Vertical end walls 88 extend upwardly from the bottom wall 78 on the table 80. Only one such wall 88 is shown in FIG. 2. There are no side walls on table 80. The end walls 88 each support a horizontally disposed trough 90 having horizontally disposed side flanges at the upper end of the trough. Track 12 is bolted to such flanges on the troughs 90. Troughs 90 have a length corresponding to the transverse width of the track 12. See FIGS. 1 and 2.

As shown in FIGS. 1 and 2, the track 12 includes a horizontally disposed rail 92 along one side of the track 12 and an upstanding guide 94. Along the other side of the track 12, there is provided a second rail in the form of a drive shaft 96. A traffic control device in the form of a cam 95 is supported by the track 12 between the rails 92, 96 whose effective surface is at the same elevation. Device 97 preferably includes a cylinder 101 for shifting the cam 95 in a direction transversely of the track when it is desired to release a vehicle. The device 97 may include a switch 98 which will be tripped by a driverless vehicle when it has come to a stop on the track 12. The troughs 90 may support bearing assemblies 99. See FIG. 1. Each bearing assembly includes a pair of cylindrical bearings below and supporting the drive shaft 96.

Referring to FIG. 2, the track 12 supports a plurality of downwardly extending rods 100 connected to a bracket for supporting the reversible electrical motor 102 and its speed reducer. The speed reducer has a pulley around which is trained belts 104. Belts 104 extend upwardly and are in contact with the drive shaft 96 for rotating the shaft 96 about its longitudinal axis.

Referring to FIG. 1, the top wall 32 supports a pair of fixed limit stops 106, 108 which are perpendicular to one another. Each of the limit stops cooperates with one of the skirts 86 to limit the pivotable movement of the table 80. In the opposite corner of the top wall 32, there is provided a pair of limit switches 110 and 112 which are perpendicular to one another for cooperation with the other skirt 86. Switch 110 is tripped when the table 80 is in the position shown in FIG. 1 and abutting limit stop 106. When the table 80 abuts limit stop 108 and is in the phantom position in FIG. 1, limit switch 112 is tripped.

A typical driverless vehicle which may be utilized with the system herein is designated 114. The vehicle 114 is a low profile vehicle having guide rollers 116 for cooperation with the upstanding guide 94 to prevent the vehicle 114 from shifting transversely of the track 12. Vehicle 114 has support wheels 118 along one side for riding on the rail 92 and one or more drive wheels 120 in frictional contact with the 12 o'clock position on the drive shaft 96 which operates as the other rail.

Operation of the turntable 10 is as follows. It is assumed that a vehicle 114 is traveling along track 14 and it is desired to be transferred to track 18. With the turntable in the position shown in solid lines in FIG. 1, track 12 is in a position to receive the vehicle 114 and this is sensed by the switch 110. A traffic control device, similar to device 97, on track 14 releases the vehicle. The vehicle is propelled by the drive shaft on track 14 which is aligned with the drive shaft 96. The vehicle 114 transfers onto the track 12 and is propelled by drive shaft 96 until a cam follower associated with the drive wheel 120 contacts the cam 95 on control device 97. Device 97 causes the vehicle 114 to come to a halt on the track 12. The vehicle trips switch 98 thereby indicating to the control panel that the vehicle is on the turntable 10 and in a stopped position.

Thereafter, valve 50 is cycled to introduce motive fluid to cause piston rod 38 to be extended to the position shown in FIG. 3. Such movement of piston rod 38 oscillates shaft 26 and pivots the table 80 to the phantom position shown in FIG. 1 wherein it contacts the limit stop 108. When this occurs, the switch 112 is tripped and communicates a signal to the control panel. Thereafter, the cam 95 on control device 97 is shifted in a transverse direction so as to allow the drive wheel 120 to pivot to a drive position. Thereafter frictional contact between drive shaft 96 and drive wheel 120 propels the vehicle 114 onto the track 18. Track 18 has a drive shaft 122 which will propel the vehicle 114 along the track 18.

The turntable 10 is now in a position to receive another vehicle from track 16 for transfer onto track 18 provided that cam 95 on traffic control device 97 is rendered inoperative so that it cannot stop the vehicle. Alternatively, cam 95 on device 97 will stop the next vehicle if such vehicle is destined to be transferred onto track 14. Any device may be used to discriminate which vehicles should be diverted to track 14 such as a photocell which detects reflective tape on the side wall of vehicles to be diverted. Thus, the turntable 10 performs the dual function of acting as part of the conveyor system for bridging across the tracks 16 and 18 for through traffic of vehicles and also acts as a turntable for transferring vehicles to and from track 14. While track 14 is perpendicular to tracks 16 and 18, track 14 may be at any acute angle with respect to the tracks 16 and 18.

It is essential that the rail 92 and drive shaft 96 be at the exact elevation of the corresponding structure on the tracks 14, 16 and 18. If there is a gross disparity, the nuts on the bolts 24 may be adjusted to raise or lower the turntable 10 with respect to the floor 22. If the floor is not level and only minor disparity is involved, the rail 82 may be provided with shims at appropriate locations. The use of shims results in a rail 82 which is not in a horizontal plane. However, the universal coupling 56 will absorb any mismatch and facilitate driving the table 80 notwithstanding the fact that the rail 82 is only generally horizontal at some locations therealong.

The piston within cylinder 42 is preferably pressurized on one side by a hyrdaulic liquid with air applied thereto for the purpose of providing smooth actuation to the table 80. The column of hydraulic liquid that is moved each time the piston is stroked prevents any jerking motion. The stroke of the piston is preferably sufficient whereby the skirt 86 will contact the limit stops 106 or 108 before the piston bottoms out whereby the table will be held against its limit stop by pressure in cylinder 42.

The present invention may be embodied in other specific forms without departing from the spirit or essential attributes thereof and, accordingly, reference should be made to the appended claims, rather than to the foregoing specification, as indicating the scope of the invention.

I claim:

1. A turntable for driverless vehicles comprising a base adapted to be attached to a floor, a vertically disposed shaft enclosed by said base, a motor means for pivoting said shaft about its vertical axis, said motor means being enclosed by said base, a circular rail supported on a top surface of said base, a table in rolling contact with said rail, said table being coupled to the upper end of said shaft by a universal coupling, a track on said table, said track having a discrete rail along opposite sides thereof, one of said rails being a horizontally disposed drive shaft, a motor on said table for rotating said drive shaft about its longitudinal axis, and a traffic control device on said track for controlling the speed of vehicles moving along said track and for causing vehicles to stop at a predetermined location on the track.

2. A driverless vehicle system comprising a T-junction having first and second aligned tracks spaced from one another by a gap and a third track terminating adjacent said gap, said third track being at an angle with respect to said first and second tracks, said tracks being at the same elevation, each track having a rail along one side and a drive shaft along an opposite side, a turntable in said gap for transferring vehicles from said third track to one of said first and second tracks and vice versa while also facilitating transfer of vehicles from said first track to said second track, said turntable having a track at the same elevation as said other tracks, the track on said turntable having a rail along one side and a drive shaft along an opposite side, mounting structure means for vertically adjusting said turntable so that the track on said turntable is at the same elevation as said other tracks, said turntable supporting a motor for rotating the drive shaft thereon about its longitudinal axis, said track on said turntable including a traffic control device for causing vehicles to stop at a predetermined location on the turntable, and motor means connected to a portion of said turntable for causing the turntable to pivot through an arc whereby its track is aligned with the first and second tracks in one position thereof and aligned with the third track in another position thereof.

3. A system in accordance with claim 2 wherein said motor for rotating the drive shaft on the turntable is a reversible electrical motor.

4. A driverless vehicle system comprising a T-junction having first and second aligned tracks spaced from one another by a gap and a third track terminating adjacent said gap, said third track being at an angle with respect to said first and second tracks, said tracks being at the same elevation, each track having a rail along one side and a drive shaft along an opposite side, a turntable in said gap for transferring vehicles from said third track to one of said first and second tracks and vice versa while also facilitating transfer of vehicles from said first track to said second track, said turntable having a track at the same elevation as said other tracks, the track on said turntable having a rail along one side and a drive shaft along an opposite side, mounting structure means for vertically adjusting said turntable so that the track on said turntable is at the same elevation as said other tracks, said turntable supporting a motor for rotating the drive shaft thereon about its longitudinal axis, said track on said turntable including a traffic control device for causing vehicles to stop at a predetermined location on the turntable, and motor means connected to a portion of said turntable for causing the turntable to pivot through an arc whereby its track is aligned with the first and second tracks in one position thereof and aligned with the third track in another position thereof, said turntable movable portion including a table riding on a circular rail supported by a stationary base therebelow, a vertical shaft pivotably supported by the base and having its upper end connected to the table by way of a universal coupling.

5. A system in accordance with claim 4 wherein said third track is perpendicular to said first and second tracks.

6. A system in accordance with claim 4 including a switch on said turntable track in a position for contact with a vehicle on said turntable track, and discrete switches actuated by said turntable movable portion at each end of said arc.

7. A turntable for driverless vehicle comprising a base having mounting structure on the lower end thereof and adapted to be supported by a floor, a vertically disposed shaft supported at its lower end by said base, a motor means supported by said base and coupled to a lower end portion of said shaft for pivoting said shaft about its vertical axis through an arc up to 90°, a table connected to the upper end of said shaft at an elevation above the elevation of said base for movement with the shaft in all positions of the shaft, said table being pivotable through said arc by said shaft about said vertical axis relative to said base, a track on said table, said track having rails along opposite sides thereof, one of said rails being a horizontally disposed drive shaft adapted for frictional contact with a drive wheel on a driverless vehicle when the vehicle is supported by said track, a motor on said table below the elevation of said drive shaft and connected thereto for rotating said drive shaft about its longitudinal axis, and a traffic control device on said table between said rails for cooperation with a drive wheel on a driverless vehicle when such vehicle is supported by said rails.

8. A turntable in accordance with claim 7 including a circular rail on said base, said circular rail being in rolling contact with support wheels on said table.

9. A turntable in accordance with claim 7 wherein said motor means is a cylinder, said cylinder having a piston rod connected to said shaft, at least one end of said cylinder being coupled to a source of hydraulic liquid capable of being selectively pressurized by air.

10. A turntable in accordance with claim 7 wherein said mounting structure is vertically adjustable to facilitate leveling of the turntable.

* * * * *